US005167843A

United States Patent [19]

Guillory

[11] Patent Number: 5,167,843

[45] Date of Patent: Dec. 1, 1992

[54] REVETMENT SYSTEM AND DEVICE

[76] Inventor: Kenneth W. J. Guillory, P.O. Box 947, Eunice, La. 70535

[21] Appl. No.: 642,401

[22] Filed: Jan. 17, 1991

[51] Int. Cl.[5] ..... F02B 3/12; B22D 19/00

[52] U.S. Cl. ..... 249/83; 249/98; 249/122; 405/16; 405/17

[58] Field of Search ..... 405/16, 17; 249/98, 249/99, 101, 102, 91, 83, 122; 52/125.1, 125.5

[56] References Cited

U.S. PATENT DOCUMENTS 837,760 12/1906 Whisler ..... 249/99 X
895,614 8/1908 Benson ..... 249/99 X
1,092,195 4/1914 Workman ..... 249/101
1,273,168 7/1918 Ferguson ..... 249/99
2,730,785 1/1956 Williams et al. ..... 249/98
4,325,575 4/1982 Holt et al. ..... 52/125.5 X

*Primary Examiner*—Dennis L. Taylor
*Attorney, Agent, or Firm*—Matthews and Associates

[57] ABSTRACT

This revetment system and device maybe employed in controlling any environmental erosion comprising a matrix of interlocking blocks stabilized through a plurality of openings or any other securing device may pass therethrough.

6 Claims, 3 Drawing Sheets

FIG

REVETMENT SYSTEM AND DEVICE

Generally, this system relates to a revetment forming device which when joined together creates a form for which concrete or any other hardenable material may be placed creating a solid block which may be used for the prevention of erosion of soil, or any other unstable surface which is susceptible to the environmental elements, such as wind and water. More specifically, the present invention relates to the utilization of interlocking blocks whereby each block comprises a protruding or recessed longitudinal side which may be interlocked to an opposite block having the inverse of the same. Thus, a matrix of blocks may be formed at any 90 degree angle direction from another interlocking block and/or may be stacked through use of a plurality of vertically extending openings through each block allowing any securing pile member to be driven through said block into the surface of the earth. Each revetment block may be stacked horizontally, vertically or above each block along a planar x, y, z axis in order to prevent the erosion of soil or other unstable surfaces. Soil erosion prevention blocks and other revetment blocks and structures are known in the art. Of the art in this particular field Pilaar, U.S. Pat. No 3,597,928 is pertinent. The patent discloses a matrix of soil erosion controlling blocks adhered to a porous, flexible mat positioned upon the land or surface where it is desired to control the erosion of soil. Of pertinence is the Landry, Jr. U.S. Pat., No. 4,227,829. Landry, Jr. discloses a matrix of soil erosion prevention blocks positioned upon a surface for controlling erosion of soil therefrom, each block having an upper, lower, plurality of side surfaces which each contain a plurality of horizontal and vertical openings in said block to permit the passage of cable and foliage to secure said blocks within a matrix to each other and the surface for which the blocks rests. Further Landry, discloses a plurality of hexagonal slanted surfaces upon on the side surfaces and upper surface of each block for the purposes of allowing soil and foliage to intertwine and secure said block in the surface and/or allow mating blocks to be attached to the sides of a given block either horizontally or vertically. Appleton, U.S. Pat. No. 3,903,702 discloses a revetment structure comprising a system of concrete blocks having vertical passageways therethrough such that a number of blocks may be positioned adjacent one another to prevent the eros±on of soil thereunder while allowing foliage, etc. to grow up through the holes or passageways within the blocks. The blocks incorporate inner-fitting v or u shapes to aid in retaining the blocks in position. Nelson, U.S. Pat. No. 3,386,252 discloses a rip-wrap structure for damns and waterways, comprising a system of rectangular blocks having a rod extending therethrough. The rods connect, hooking the blocks together to form a matrix. Similarly, Palmer, U.S. Pat. No. 3,990,247 discloses a revetment structure comprising a system of cylindrical members interconnected by a series of rods.

The problems with each of the above mentioned devices is that the various blocks either had to be fabricated and/or transported to the site desired to be protected from soil erosion, and installed one at a time, or as in the case of Landry where small blocks attached in sequence by a cable supporting means were constructed.

SUMMARY OF THE INVENTION

The present invention is directed to a block of any hardenable material such as concrete for use in the prevention of soil erosion, comprising a plurality of facings which when joined together creates a revetment block which has protruding and recessed vertical sides permitting the interlocking of each block with another block to form a revetment structure. Furthermore, each block has a plurality of openings extending from the bottom to its surface permitting the stability of each block to the surface of said erosion site, or the surface of another block through any piling means or other securing means. Thereafter, the form may be dismantled from the block and re-used for forming numerous revetment blocks.

DETAILED DESCRIPTION OF THE PREFERRED EMBODIMENT

Figure 1:
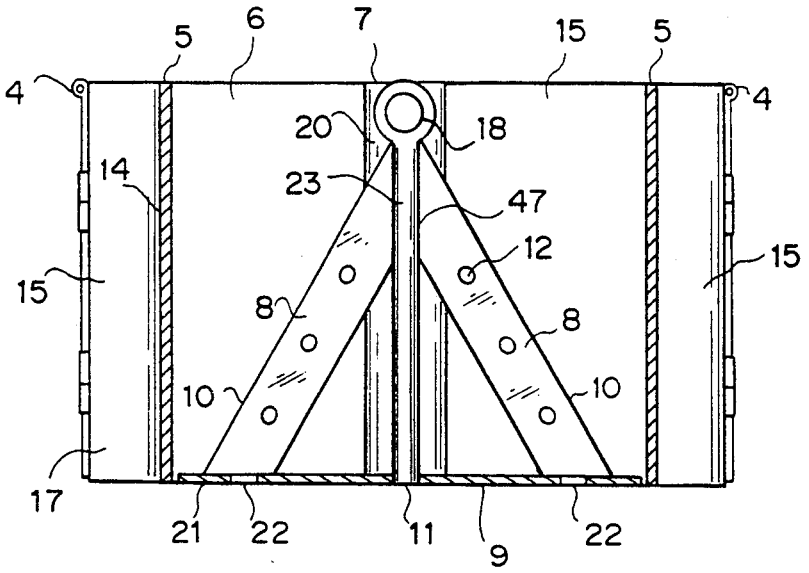
FIG. 1 is a cut-away cross-sectional view of the revetment forming device.
Figure 2:
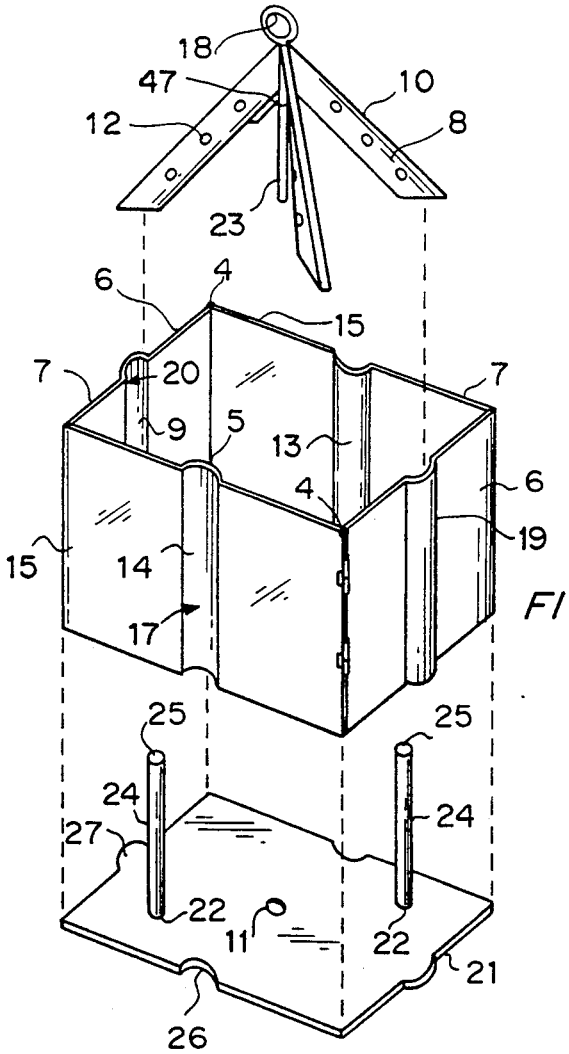
FIG. 2 is an isometric view of the revetment forming device which depicts the facing, reinforcement and base means.

Referring now to the drawings, and more specifically to FIG. 1, the soil erosion prevention apparatus form is illustrated in its entirety by reference to FIG. 2, and is shown comprising hook means 18, and an outer hook means 19, and an outer hook means 19, to provide for the removal of the revetment block once formed around the anchor and reinforcing means 8, 10, and 12 which provide a flat planar surface 8 with a plurality of radially displaced openings 12 to insure stability and solidity of the revetment block once formed. FIG. 2 further comprises a revetment forming device essentially composed of a pair of perpendicular and planar surfaces 6 and 15, having an ideally uppermost planar surface 7 and lowermost planar surface 21.

Planar surfaces 6 and 15 are positioned in perpendicular fashion and of equal distance such as to form a perfect square enclosure having an extendable height manufactured from either four feet to eight feet depending on the necessary requirements for erosion control.

Figure 5:
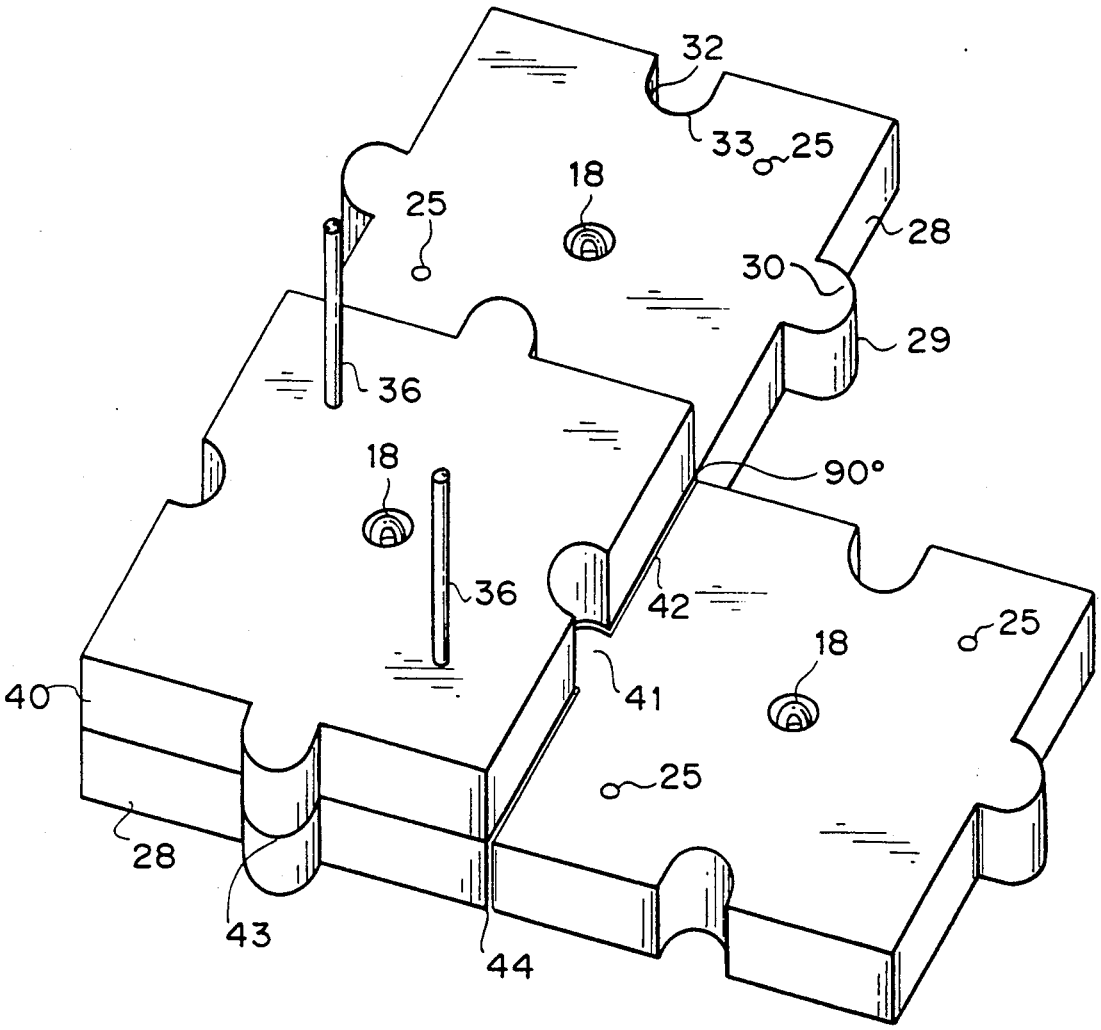
FIG. 5 is a perspective isometric view of interlocking formed revetment structures.

FIG. 1 shows the operation of the revetment forming device implemented just prior to pouring a hardenable material into the cavity encompassing the reinforcing means 8, 10 and 12 being poured to a height even with 7. In pouring the hardenable substance into the cavity and about the reinforcing means 8, 10 and 12, the hardenable substance will fill the pair of cavities 20 and will surround the metal casings 24 such as when removed will form the revetment block for erosion control as depicted in FIG. 5.

Figure 3:
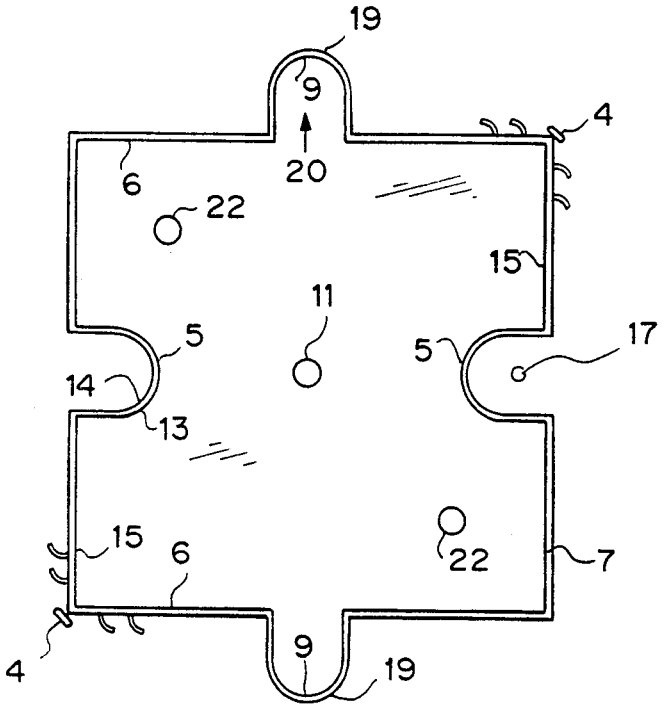
FIG. 3 is a top view of the revetment forming device depicting the facing means and base means containing internal radial openings.

FIG. 3 depicts the revetment form as shown from a top view demonstrating the base 21 having cavities 20 and 17 for interlocking purposes inclusive of recesses and protrusions 9 further aiding interlocking. The said recesses have an external surface 14 and internal surface 13; said protrusions have an internal surface 9 external surface 19. The equi-distant and perpendicular revetment halves 15 and 6 are joined by fastening means 4, whereby once joined, fit snugly and in sealing engagement with said base 21 which has identical recesses 26 and protrusions 27 to match the facing of the enclosures 5 and 9. Said hook means 18 is fastened to said reinforcing means 23 by any welding means so when once removed from the revetment form, the block may be lowered in position in any fashion at the site and thereby the hook means 18 is even with the uppermost end of the formed revetment block, providing an opening such as 18 of FIG. 5. Casing 24 may incorporate and support pilings that may be driven into the earth's surface to provide stability to the revetment block.

Said reinforcing means 8, 10 and 12 is welded to said reinforcing means 23 at 47. Subsequently, said hook means 18, reinforcing means 8, 10 12, and 23 are thereafter welded to said base means 21; said base means containing a plurality of holes 22 for metal casings 24 to be fastened thereto, and is welded onto said base means 21. Thereafter, said metal casings 24 containing openings 25 are welded into said openings 22 of said base depicting the structure in FIG. 4 which is then lowered into said facings 15 and 6 whereby said facings are joined previously by fastening means 4 essentially forming the structure as depicted in FIG. 1.

Having completed this initial preparation of welding the casings 24 and reinforcing means to said base means 21 and lowering the same into said cavity of said facings 15 and 6, any hardenable substance such as cement, is poured into and surrounding said structure as depicted in FIG. 1 up to and even with said hook means 18 and said casings 24. Once hardened, the fastening means 4 and facings 15 and 6 are removed and the revetment structure as depicted in FIG. 5 may be lowered into position by said hook means 18.

Referring to FIG. 3, said facings 15 and 6 are provided with the previously mentioned protrusions and recesses 5 and 9 respectively which contain cavities 20 and 17 respectively to allow interlocking. Said facings 15 and 6 and recesses and protrusions 5 and 9 respectively are of ample thickness to allow for the load that the hardenable substance would bear upon the walls once the internal cavities of the revetment form are filled to the upppermost surface 7. Said base contains openings 11 and 22 to allow reinforcing means 23 and casings 24 to be welded thereto. Casing openings 25 of FIG. 5 of the revetment block 28 provide for a piling means 36 to pass through and secure the blocks into the surface of the earth.

FIG. 5 depicts the revetment block 28 once formed by the previously described apparatus and procedure and essentially describes a hook means 18 by which the revetment block 28 may be lowered into position leaving hook means 18 exposed just below the upper surface of said revetment block. Each revetment block 28 contains an protrusion 29 and recess 32 providing for interlocking means. Openings 25 further facilitate the increased stability allowing for the insertion or implementation of a support means such as pilings 36 through the block and into the earth to secure said revetment block. Each revetment block contains an upper surface 30 extending approximately four to eight feet above the lower end of the base means of said revetment block which is comprised of a metal plate 21 with openings 22 and 11. Revetment blocks are interlocked at 90 degree angles to each other as depicted in FIG. 5, and may be stacked as shown at 42. When a revetment block is placed in above relation to another (stacked), they are even as shown at 43. Said upper revetment block 40 may be secured through any piling means 36 to lower said revetment block 28. Said hook means 18 may be used to transport or rearrange each revetment block according to site requirements and location, thus, said revetment blocks may be placed in any position allowing any protrusion 29 to interlock with a recess 32 in sealing engagement with said revetment blocks such as 41, 42 and 44. Further, said revetment blocks may be placed in any fashion in over and above relation to each other in sealing engagement such as at 43. This process may be repeated thereby forming a revetment bridge or structure sufficient to withstand heavy loads. Each block in its ideal function will be six feet wide by six feet long by four to eight feet high and constructed of any hardenable material such as cement. However, such is not intended as a limitation but merely as an objective embodiment of the present invention.

Figure 4:
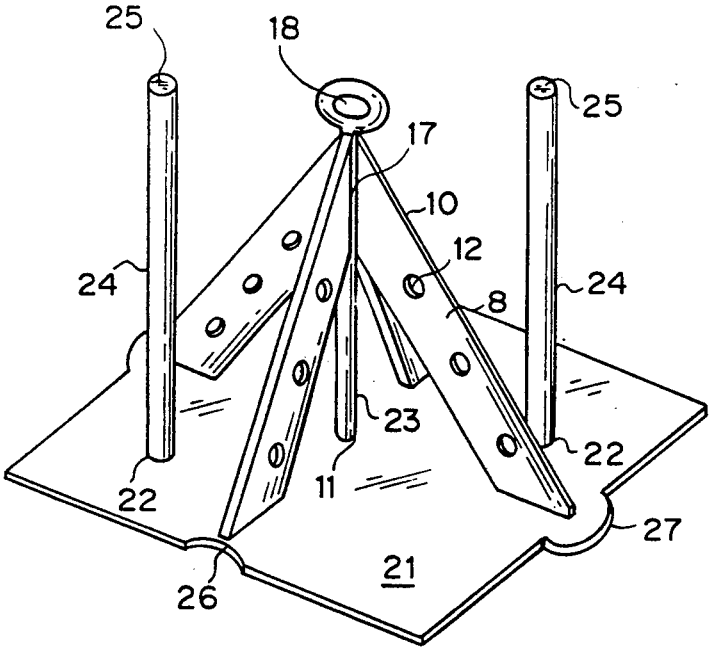
FIG. 4 is an isometric view of the reinforcement means used to stabilize the hardenable substance forming the revetment structure.

The ideal method of forming said revetment blocks comprises welding said hook means 18 to said reinforcing means 23 which has previously been welded to said reinforcing means 8, 10 and 12 at 47 and said base means 21 of FIG. 2. Thereafter, said metal casings 24 may be lowered and welded to said base at 22 whereafter, the entire structure as depicted in FIG. 4 may be lowered into said facings 15 and 6 which have been previously joined by said fastening means 4 in sealing engagement, as depicted in cut-away view FIG. 1. Following this procedure, the hardenable material is poured into the cavities which surround said reinforcing structures 8, 10 and 12 and is in contact with said recesses 5, protrusions 9, facings 15 and 6, base 21, and metal casings 24. Once hardened the revetment block may be moved and placed into position such as depicted in FIG. 5. Then said pilings 36 may be driven into the earth to secure said revetment blocks in over and above relation to each other.

It is understood that certain features of sub-combinations are of utility, and may be employed with a preference to other features and sub-combinations. This is contemplated by and is within the scope of the claims.

As many possible embodiments may be made of the invention without departing from the scope thereof, it is to be understood that all matter herein set forth or shown in the accompanying drawings is to be interpreted as illustrative, and not in a limiting sense.

What is claimed is:

1. An apparatus for forming a revetment system for prevention of soil erosion and the like comprising:

(a) a base means having a plurality of openings therein;

(b) a facing means joined above said base means, said facing means consisting of a plurality of walls;

(c) a fastening means joining said facing means about said base; and, (d) a reinforcing means positioned within said facing means for enabling strengthening of a hardenable substance when the hardenable substance is poured within said facing means, said hardened substance forming a revetment block for use to prevent soil erosion and other environmental damage.

2. An apparatus as set forth in claim 1 wherein said base means comprises a plurality of protrusions and recesses located about the perimeter of said base means to enable interlocking of the revetment structures.

3. An apparatus as set forth in claim 1 wherein said facing means comprises vertically extending protrusions and recesses equidistantly spaced on each facing means, and in line with said protrusions or recesses located about the perimeter of said base means to enable interlocking of the revetment structures.

4. An apparatus as set forth in claim 1 wherein said fastening means comprise vertical rods connecting said facing means in temporary fashion to form an enclosure about said base means.

5. An apparatus asset forth in claim 1 wherein said reinforcing means comprises plurality of angularly positioned members terminating at a hook means which assists and aids in the reinforcement of a hardenable material.

6. An apparatus as set forth in claim 1 wherein said base means further comprise a plurality of casings joined to said openings radially located about said base and vertically extending upward.

* * * * *